US011224872B2

(12) United States Patent
Deng et al.

(10) Patent No.: US 11,224,872 B2
(45) Date of Patent: Jan. 18, 2022

(54) PIPETTE BASED ON SURFACE CHARGES

(71) Applicant: University of Electronic Science and Technology of China, Chengdu (CN)

(72) Inventors: Xu Deng, Chengdu (CN); Qiangqiang Sun, Chengdu (CN); Yu Zhou, Chengdu (CN)

(73) Assignee: UNIVERSITY OF ELECTRONIC SCIENCE AND TECHNOLOGY OF CHINA, Chengdu (CN)

( * ) Notice: Subject to any disclaimer, the term of this patent is extended or adjusted under 35 U.S.C. 154(b) by 184 days.

(21) Appl. No.: 16/575,412

(22) Filed: Sep. 19, 2019

(65) Prior Publication Data

US 2020/0406249 A1 Dec. 31, 2020

(30) Foreign Application Priority Data

Jun. 27, 2019 (CN) ..... 201910565046.0

(51) Int. Cl.
*B01L 3/02* (2006.01)

(52) U.S. Cl.
CPC ..... *B01L 3/021* (2013.01); *B01L 2300/12* (2013.01); *B01L 2300/165* (2013.01); *B01L 2400/0424* (2013.01)

(58) Field of Classification Search
None
See application file for complete search history.

(56) References Cited

U.S. PATENT DOCUMENTS

2002/0110902 A1* 8/2002 Prosser ..... G01N 35/04 435/287.1
2002/0142483 A1* 10/2002 Yao ..... G01N 1/10 436/180
2003/0080087 A1* 5/2003 Stelzle ..... B01L 3/0241 216/27
2005/0042866 A1* 2/2005 Klapproth ..... B01J 19/0046 506/32
2007/0178014 A1* 8/2007 Haushalter ..... B01L 3/0248 422/400
2007/0231458 A1* 10/2007 Gale ..... B01L 3/50273 427/2.11
2015/0118728 A1* 4/2015 Rahman ..... G01N 33/54333 435/173.9
2017/0059508 A1* 3/2017 Knopfmacher ..... C12Q 1/025
(Continued)

*Primary Examiner* — Brian R Gordon
(74) *Attorney, Agent, or Firm* — Bayramoglu Law Offices LLC

(57) ABSTRACT

A pipette based on surface charges includes a pipette body. A plurality of support rods are provided below the pipette body. Connecting rods are provided at the lower ends of two adjacent support rods. A substrate is provided between the connecting rods. A porous $SiO_2$ coating is provided on the substrate. A hydrophobic molecule layer is provided on the surface coating by the vapor deposition method. A super-amphiphobic surface is formed on the substrate by the surface coating and the hydrophobic molecule layer. The substrate and the surface coating are made of dielectric materials. A circular limit plate is provided above the pipette body. The pipette body, the support rods, the connecting rods and the limit plate are integrally formed, and are electrically non-conductive. An electrically conductive sliding rod is movably provided within the pipette body and the limit plate.

7 Claims, 1 Drawing Sheet

(56) References Cited

U.S. PATENT DOCUMENTS

| | | | | |
|---|---|---|---|---|
| 2017/0212075 | A1* | 7/2017 | Knopfmacher .. | G01N 33/48714 |
| 2017/0342459 | A1* | 11/2017 | Knopfmacher .... | G01N 33/5011 |
| 2018/0164577 | A1* | 6/2018 | Dryfe ..... | G02B 26/004 |
| 2018/0195106 | A1* | 7/2018 | Knopfmacher ..... | C12Q 1/18 |
| 2020/0023357 | A1* | 1/2020 | Glasgow ..... | B01L 3/50857 |

* cited by examiner

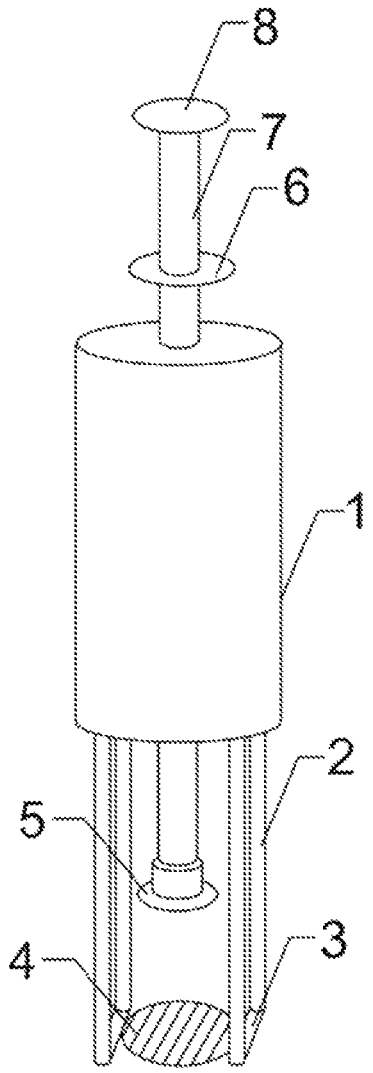
8
7
6
1
2
5
4
3

PIPETTE BASED ON SURFACE CHARGES

CROSS REFERENCE TO THE RELATED APPLICATIONS

This application is based upon and claims priority to Chinese Patent Application No. 201910565046.0, filed on Jun. 27, 2019, the entire contents of which are incorporated herein by reference.

TECHNICAL FIELD

The present disclosure belongs to the technical field of pipettes, and in particular relates to a pipette based on surface charges.

BACKGROUND

In analytical experiments, especially the analytical experiments involving expensive reagents, the loss-free transfer is essential to the liquid. In the meanwhile, single-drop analytical equipment has attracted more and more attention. Currently, researchers have designed a mechanical adjustment surface for manipulating droplets. However, the mechanical adjustment surface merely works on aqueous solutions. When dealing with low surface tension or highly viscous liquids, the mechanical adjustment surface does not work. When the traditional pipette is used for transferring these droplets, the problem of mass loss and contamination due to the large contact area and adhesiveness between solid and liquid. Therefore, a new pipette is designed to easily manipulate any liquid, including low-surface-tension liquid and high-viscosity liquid, without mass loss and contamination.

SUMMARY

To overcome the above-mentioned deficiencies, the present disclosure provides a pipette based on surface charges, which uses a superamphiphobic surface to replace the tip of the pipette. When pipetting, the water droplet hits the superamphiphobic surface to generate charges on the surface, and then the superamphiphobic surface after being charged has high adhesion to the droplet so as to capture and shift the droplet.

To achieve the above-mentioned objectives, the technical solution of the present disclosure to resolve the technical problems is as follows: a pipette based on surface charges includes a pipette body. A plurality of support rods are provided below the pipette body. Connecting rods are provided at lower ends of two adjacent support rods. A substrate is provided between the connecting rods. A porous $SiO_2$ coating is provided on the substrate. A hydrophobic molecule layer is provided on the surface coating by the vapor deposition method. A superamphiphobic surface is formed on the substrate by the porous $SiO_2$ coating and the hydrophobic molecule layer. The substrate and the superamphiphobic surface coating are both made of dielectric materials. A circular limit plate is provided above the pipette body. The pipette body, the support rods, the connecting rods and the limit plate are integratedly formed, and are electrically non-conductive. An electrically conductive sliding rod is movably provided through the pipette body and the limit plate. A sheet conductor is provided at the lower end of the sliding rod. A push plate is provided at the upper end of the sliding rod.

The advantages of the present disclosure are as follows: during pipetting, the sheet conductor is away from the superamphiphobic surface, the pipette body is held by hand to make the superamphiphobic surface close to the droplet, and the water droplet hits the superamphiphobic surface to generate electric charges, which can be used to generate the surface charges on the superamphiphobic surface, and can be sustained for a long time. The surface charges can greatly enhance the adhesiveness of the droplet on the superamphiphobic surface, and keep the surface in a superamphiphobic state, and achieving the droplet capture. After that, the droplet is moved to the predetermined position, and the push plate is pushed, so that the sliding rod drives the sheet conductor to get close to the superamphiphobic surface, thereby generating the electrostatic induction. The electrostatic induction can temporarily eliminate the effect of surface charges to diminish the adhesiveness between the droplet and the superamphiphobic surface to almost zero, thereby releasing the droplet and completing the capture and shift of the droplet. The superamphiphobic surface has the property of repelling droplets, so that the liquid is in a spherical state on the surface. Printing the surface charges will increase the adhesion of the superamphiphobic surface to the droplets, thereby capturing the droplets. The pipette provided by the present disclosure captures the liquid droplets through the superamphiphobic surface, without specialized tip, so that the liquid does not infiltrate or adhere to the inner wall of the tip, and does not adhere to the superamphiphobic surface. Hence, there is no mass loss. The transferred liquid remains in a spherical state during the whole transfer process, and has a limited contact area with the surface, thereby causing no droplet contamination. Moreover, the pipette is not only suitable for aqueous solutions, but also for the low-surface-tension or high-viscosity liquid, such as blood, ethanol solutions, glycerol and so on.

Further, the distance from the limit plate to the substrate is greater than the length of the sliding rod.

The advantages of using the above-mentioned further solution are as follows: preventing the lower end of the sliding rod from damaging the superamphiphobic surface on the substrate during the sliding process.

Further, the material of the substrate is glass, polytetrafluoroethylene or a copolymer of fluorinated ethylene propylene.

Further, the hydrophobic molecule layer is a layer of perfluorooctyl trichlorosilane molecules.

Further, the substrate has a thickness of 160-180 μm and a diameter of 16-19 mm.

Further, the surface coating has a thickness of 5-50 μm.

Further, the sheet conductor has a thickness of equal to or more than 0.5 mm.

BRIEF DESCRIPTION OF THE DRAWINGS

FIG. 1 shows a schematic view of an embodiment of the present disclosure; wherein a pipette includes, 1. pipette body; 2. support rod; 3. connecting rod; 4. substrate; 5. sheet conductor; 6. limit plate; 7. sliding rod; and 8. push plate.

DETAILED DESCRIPTION OF THE EMBODIMENTS

The specific embodiments of the present disclosure will be described in detail below with the drawings.

In an embodiment of the present disclosure, as shown in the FIGURE, a pipette based on surface charges includes the pipette body 1, the plurality of support rods 2 provided below the pipette body 1, the connecting rods 3 provided at the lower ends of two adjacent support rods 2, and a thin glass sheet, i.e. the substrate 4, provided between the connecting rods 3. The thin glass sheet has a thickness of 170 μm and a diameter of 18 mm. A hydrophobic surface coating is provided on the thin glass sheet, a layer of perfluorooctyl trichlorosilane molecules is provided on the surface coating by the vapor deposition method. A superamphiphobic surface is formed on the thin glass sheet by the surface coating and the layer of perfluorooctyl trichlorosilane molecules. The thin glass sheet and the surface coating are both made of dielectric materials. The circular limit plate 6 is provided above the pipette body 1. The pipette body 1, the support rods 2, the connecting rods 3 and the limit plate 6 are integratedly formed by the 3D printing, and are electrically non-conductive. The electrically conductive sliding rod 7 is movably provided through the pipette body 1 and the limit plate 6. The sheet conductor 5 is provided at the lower end of the sliding rod 7, and is a glass sheet having a thickness of 0.5 mm. The push plate 8 is provided at the upper end of the sliding rod 7. The distance from the limit plate 6 to the substrate 4 is greater than the length of the sliding rod 7 in order to prevent the lower end of the sliding rod 7 from damaging the superamphiphobic surface on the substrate 4 during the sliding process. During pipetting, the copper sheet is away from the superamphiphobic surface, the pipette body 1 is held by hand to make the superamphiphobic surface close to the droplet, and the water droplet hits the superamphiphobic surface to generate electric charges, which can be used to generate the surface charges on the superamphiphobic surface, and can be sustained for a long time. The surface charges can greatly enhance the adhesiveness between the droplet and the superamphiphobic surface, and keep the droplet in a superamphiphobic state, and achieving the capture of droplets. After that, the droplet is moved to the predetermined position, and the push plate 8 is pushed, so that the sliding rod 7 drives the copper sheet to get close to the superamphiphobic surface, thereby generating the electrostatic induction. The electrostatic induction can temporarily eliminate the effect of surface charges to diminish the adhesiveness between the droplet and the superamphiphobic surface to almost zero. As a result, the droplets are released and the capture and shift of the droplet are achieved. The superamphiphobic surface has the property of repelling droplets, so that the liquid is in a spherical state on the surface. Printing the surface charge will increase the adhesion of the superamphiphobic surface to the droplets, thereby capturing the droplets. The pipette provided by the present disclosure captures the liquid droplets through the superamphiphobic surface, without a specialized tip, so that the liquid fails to infiltrate or adhere to the inner wall of the tips, and fails to adhere to the superamphiphobic surface. Thus, there is no mass loss. The transferred liquid remains in a spherical state during the whole transfer process, and has a limited contact area with the surface, thereby causing no droplet contamination. Further, the pipette is not only suitable for aqueous solutions, but also for the low-surface-tension or high-viscosity liquid, such as blood, ethanol solutions, glycerol and so on.

The preparation method of the superamphiphobic surface in the embodiment is as follows: a thin glass sheet was baked back and forth on a candle soot flame for 2 minutes, and a candle soot coating was evenly covered on a surface of the substrate 4. 1 mL of 25 wt % ammonia water and 1 mL of 97 wt % tetraethoxysilane were placed on both sides of a dryer. Then, the glass sheet obtained in the previous step was placed on a ceramic frame in the middle. The vacuumizing to 0.1 Pa for 24 hours is performed to grow a porous structure of $SiO_2$@C. After that, the glass sheet was taken out and calcined at 550° C. for 3 hours to obtain a hollow $SiO_2$ porous structure, and the hollow $SiO_2$ porous structure is treated by air plasma for 10 min. Next, 100 μL of 97 wt % perfluorooctyl trichlorosilane was placed on one side of the dryer, and the glass sheet obtained in the previous step was placed in the dryer. The vacuumizing to 0.1 Pa for 1 hour is performed to obtain a superamphiphobic surface of the present embodiment.

In use, the pipette body 1 is held by hand to make the superamphiphobic surface close to the droplet, and the water droplet hits the superamphiphobic surface to generate electric charges. The surface charges can greatly enhance the adhesiveness between the droplet and the superamphiphobic surface, and keep the droplet in a superamphiphobic state, so that the droplet is attached to the superamphiphobic surface. Then, the droplet is moved to the predetermined position, and the push plate 8 is pushed, so that the sliding rod 7 drives the sheet copper to approach the superamphiphobic surface, thereby generating electrostatic induction. The electrostatic induction can temporarily eliminate the effect of surface charges, thereby releasing the droplets and completing the capturing and shift of the droplet. In the present disclosure, the tip of the pipette is replaced by a superamphiphobic surface. During pipetting, the water droplet hits the superamphiphobic surface and generates charges on the surface. The charged superamphiphobic surface has high adhesiveness to the droplet to capture and shift the droplet.

Although the specific embodiments of the present disclosure are described in detail in combination with the drawings, no limit to the protection scope of the present patent is formed by the specific embodiments. Within the scope of the claims, various modifications and variations made by the person skilled in the art without creative work are still within the protection scope of the present patent.

What is claimed is:

1. A pipette based on surface charges, comprising:

a pipette body including an upper end and a lower end;

a plurality of support rods provided at and connect to the lower end of the pipette body;

two connecting rods, wherein the two connecting rods are each respectively connected to and between respective lower ends of one of a first or second pair of two adjacent support rods of the plurality of support rods; the first pair is different from the second pair;

a substrate connected to and between the two connecting rods, wherein a porous $SiO_2$ coating is provided on the substrate, a hydrophobic molecule layer is provided on the hydrophobic surface coating, a superamphiphobic surface is formed on the substrate by the porous $SiO_2$ coating and the hydrophobic molecule layer, and the substrate and the porous $SiO_2$ coating are made of dielectric materials;

an electrically conductive sliding rod movably provided through the pipette body;

a circular limit plate provided around the electrically conductive sliding rod above the pipette body, wherein the electrically conductive sliding rod is movably provided through the circular limit plate; and the pipette body, the support rods, the two connecting rods and the circular limit plate are electrically non-conductive;

a sheet conductor connected to and provided at a lower end of the electrically conductive sliding rod; and a push plate connected to and provided at an upper end of the electrically conductive sliding rod.

2. The pipette based on the surface charges of claim 1, wherein a distance from the circular limit plate to the substrate is greater than a length of the electrically conductive sliding rod.

3. The pipette based on the surface charges of claim 1, wherein a material of the substrate is glass, polytetrafluoroethylene or a copolymer of fluorinated ethylene propylene.

4. The pipette based on the surface charges of claim 1, wherein the hydrophobic molecule layer is a layer of perfluorooctyl trichlorosilane molecules.

5. The pipette based on the surface charges of claim 1, wherein the substrate has a thickness of 160-180 μm and a diameter of 16-19 mm.

6. The pipette based on the surface charges of claim 1, wherein the superamphiphobic surface coating has a thickness of 5-50 μm.

7. The pipette based on the surface charges of claim 1, wherein the sheet conductor has a thickness of equal to or more than 0.5 mm.

* * * * *